United States Patent [19]

Gheblikian

[11] Patent Number: 4,905,482

[45] Date of Patent: Mar. 6, 1990

[54] FINGER RING WITH INTERCHANGEABLE SETTINGS

[76] Inventor: Joseph A. Gheblikian, 4693 Stonehenge Dr., Atlanta, Ga. 30340

[21] Appl. No.: 308,536

[22] Filed: Feb. 10, 1989

[51] Int. Cl.[4] ..... A44C 17/02

[52] U.S. Cl. ..... 63/29.1; 63/15

[58] Field of Search ..... 63/15, 29.1, 26, 27

[56] References Cited

U.S. PATENT DOCUMENTS

| | | | |
|---|---|---|---|
| 684,272 | 10/1901 | Lambert | 63/29.1 |
| 1,704,867 | 3/1929 | Peters . | |
| 1,740,060 | 12/1929 | Baum | 63/29.1 |
| 1,877,750 | 9/1932 | Birnbaum . | |
| 1,889,862 | 12/1932 | Kessler . | |
| 1,971,265 | 8/1934 | King | 63/29.1 X |
| 2,530,432 | 11/1950 | Imowicz . | |
| 3,307,375 | 3/1967 | Estrin . | |
| 3,543,535 | 12/1970 | Siegel . | |
| 3,568,467 | 3/1971 | Ellison . | |
| 3,626,718 | 12/1971 | Schneider | 63/29.1 |
| 3,635,047 | 1/1972 | Gilbert . | |
| 4,030,605 | 6/1977 | McCarthy . | |
| 4,374,470 | 2/1983 | Isaaason . | |
| 4,488,415 | 12/1984 | Jenkins . | |

FOREIGN PATENT DOCUMENTS

| | | | |
|---|---|---|---|
| 779086 | 3/1935 | France | 63/29.1 |
| 1417745 | 10/1965 | France | 63/29.1 |

*Primary Examiner*—James R. Brittain

*Attorney, Agent, or Firm*—Sanford J. Asman

[57] ABSTRACT

The finger ring has a mounting which has a face. There is an opening on the face which extends into a cavity in the mounting. A slot on one side of the cavity provides access to the cavity and permits a setting to be slid into the opening where it is exposed from the face of the ring. Preferably, there is a slideable door which can be used to close off the slot when a setting is in place.

7 Claims, 3 Drawing Sheets

FINGER RING WITH INTERCHANGEABLE SETTINGS

BACKGROUND OF THE INVENTION

The present invention relates to finger rings. In particular, the invention relates to a finger ring which includes means for permitting settings to be easily and rapidly interchanged.

Finger rings including a variety of interchangeable settings have heretofore been proposed. Such rings have included a number of different types of apparatus adapted to permit their settings to be interchanged.

Typically, the rings of the prior art made use of slide-in settings, together with latches. Alternatively, hinged and latched mechanisms were used. In the rings of the prior art, the mechanisms which permitted the settings to be interchanged were typically either mechanically complicated, i.e., including latches and/or hinges, or they did not provide a secure means for holding their settings in place, i.e., they relied upon the presence of the finger of the wearer to hold the setting in place.

SUMMARY OF THE INVENTION

The present invention is a ring mounting which has a cavity that is open on the face of the ring. The cavity includes an entrance slot on one side through which a setting can be slideably introduced into the cavity. The entrance slot is preferably covered by a slideable door which cannot be opened while the ring is being worn (due to the wearer's finger occupying the space into which the door would have to slide), thereby securing the setting in place. In the preferred embodiment of the invention, the setting (and, therefore, the cavity and opening) are substantially rectangular. Also, in the preferred embodiment of the invention, the setting has a substantially flat face, although the shape of the face (together with the shape of the cavity) can be changed, as desired.

BRIEF DESCRIPTION OF THE DRAWING

In the Drawing.

FIG. is a top view of the ring of the present invention, illustrating the manner in which the ring appears with a first setting in place.

DETAILED DESCRIPTION OF THE PREFERRED EMBODIMENT

Figure 1:
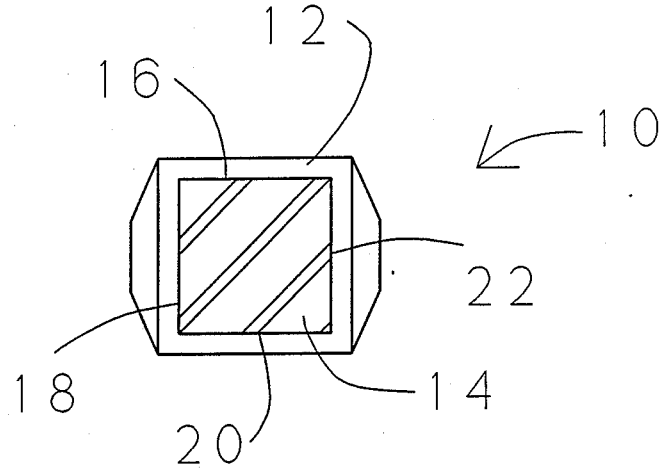

Referring to FIG. 1, the ring 10 of the present invention is shown. The ring 10 of the preferred embodiment is comprised of a mounting which has a substantially rectangular face 12 containing an opening bounded by four edges 16, 18, 20, 22. Through the opening, a setting 14 is visible. As used herein the term "setting" is meant to include any type of decorative design of the type which may be placed in a ring 10 of the type disclosed, and the term "face" is meant to include the normally exposed portion of the mounting when the ring 10 is worn, i.e., the portion of the ring 10 which holds the setting. Accordingly, the setting 14, while illustrated herein as being a composite made up of semiprecious stones, could alternatively be comprised of a single gemstone, or an initial, or other similar indicia.

With continued reference to FIG. 1, the ring 10 includes sides 17, 19, 21, 23 which extend out of the plane defined by the face 12 of the preferred embodiment of the invention. These sides 17, 19, 21, 23 are the portions of the setting which bound the face when the ring 10 is worn. Thus, referring to FIG. 1, the face 12 of the ring 10 is bounded by sides 16, 18, 20, 22.

Figure 2:
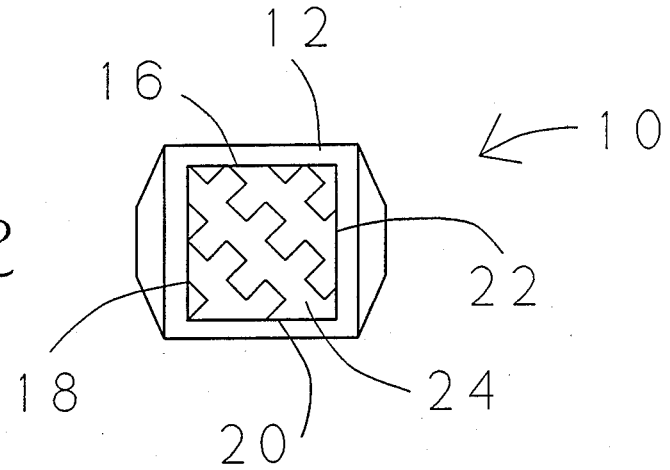
FIG. 2 is a top view of the ring of FIG. 1 with a different setting in place.

Referring to FIG. 2, in which like elements are referenced by like reference numbers, the ring 10 of the present invention is again illustrated, but with a different setting 24 inserted into it. As will be explained, the ring 10 of the present invention provides for very simple interchangeable settings.

Figure 3:
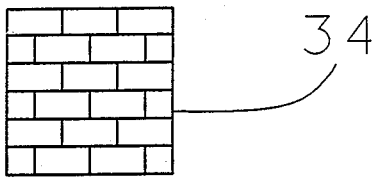
FIG. 3 is a top view of a setting removed from the ring of FIG. 1, illustrating the shape of the insertable setting used with the preferred embodiment of the invention.

Referring to FIG. 3, a setting 34, different from the settings 14, 24 illustrated in FIGS. 1 and 2, is shown. As can be observed in FIG. 3, the settings 14, 24, 34 used with the preferred embodiment of the invention are substantially rectangular, having edges which are somewhat longer in length than the edges 16, 18, 20, 22 of the opening in the face of the ring (shown in FIGS. 1 and 2). The greater length of the sides of the settings 14, 24, 34, when compared to the length of the edges 16, 18, 20, 22 of the opening in the top of the ring 10 causes the edges 16, 18, 20, 22 to overlap and frame the faces of the settings 14, 24, 34 and insures that the settings 14, 24, 34 can not fall through the opening in the face of the ring 10. While a rectangular opening is shown in connection with the preferred embodiment of the invention, other shapes, i.e., a square or a triangular opening could also be used without departing from the present invention. Similarly, if one wanted to use a shape which was not monotonically increasing in size (when viewed from the portion of the setting which was first inserted through the slot 26), then that could also be done. However, in such instance it would be necessary for the face of the ring nearest the slot to be somewhat greater than the widest part of the setting to be slid therethrough.

Figure 4:
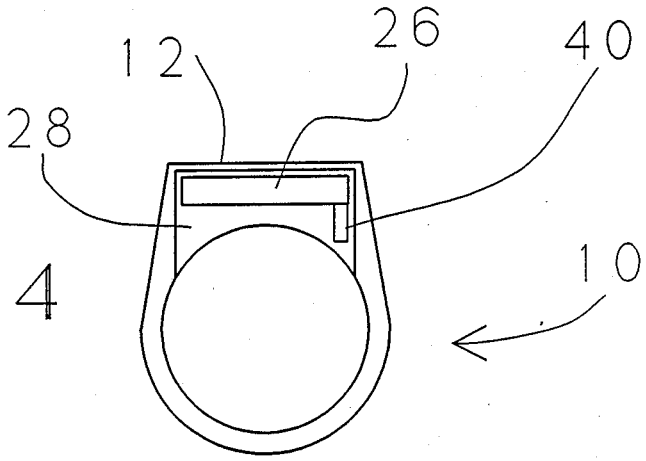
FIG. 4 is a side view of the ring of FIG. 1 illustrating the slot into which the setting are inserted.
Figure 5:
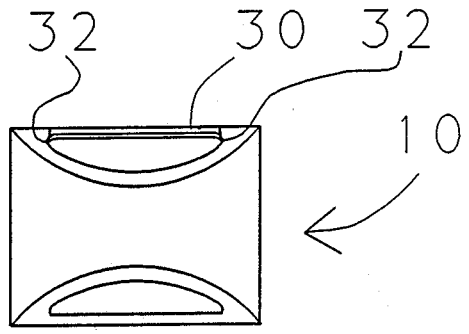
FIG. 5 is a bottom view of the ring of FIG. 1 showing the manner in which a slideable door is inserted over the slot which provides access to the cavity in which a setting is retained.

Referring now to the side view of FIG. 4, the slot 26, into which a setting may be inserted, is illustrated. The slot 26 is in a recessed portion 28 on the side of the ring 10 adjacent to the face 12 of the ring. With refence to FIGS. 5 and 6, after a setting has been inserted into the slot 26, the slot 26 may be covered by a slideable door 30 which overlies the recessed portion 28 and serves to retain the setting in place. The side edges of the slideable door 30 are preferably fitted within grooves 32 (See FIG. 5) which are formed adjacent to the top edges of the slot 26, and the edges of the door 30 are beveled, as shown, so that when the door 30 is fully closed, its top surface is flush with the surface of the ring 10.

When one wishes to replace a setting, the ring 10 is removed from the finger of the wearer. Then, the slideable door 30 is slid in the direction of the arrow shown in FIG. 6, whereby the slot will be exposed (as shown in FIG. 4). Any setting which is contained in the cavity exposed by the slot 26 is then slid out of the slot 26, and a new setting can be inserted into the slot 26. In order to facilitate opening the slideable door 30, the surface of the door 30 may have an indented portion 36 formed therein, so one an insert one's fingernail into the indented portion 36 in order to slide the door 30 open. Alternatively, instead of an indented portion or notch, a raised portion, or tab, could be used. This is especially convenient if door 30 makes a snug fit when closed. If desired, the setting can be made slightly longer than the opening, whereby the setting will place pressure on the door 30 when the door 30 is slid shut, thereby helping the door 30 to remain securely shut.

Figure 6:
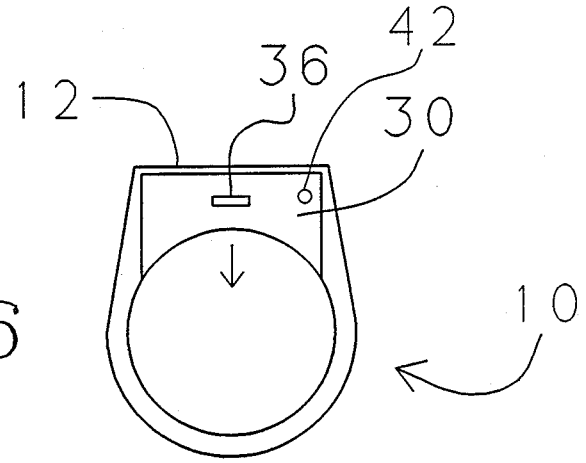
FIG. 6 is a side view, similar to FIG. 4, with the door covering the slot which provides access to the cavity in which the setting is placed.

If desired, an opening 40 can be formed in the door 30, as shown in FIG. 6, and a cavity 42 may be formed in the recessed portion of the mounting, as shown in FIG. 4. Then, a pin can be placed through the opening 40 when the ring 10 is manufactured. The pin can be either fixed in place in the door 30, or, alternatively, the opening 40 can be tapped and the pin can be comprised of a screw or threaded shaft which is removeably inserted through the door 30. If a pin is used, then the door 30 may be slid open, but not fully removed from the mounting, thereby preventing the door 30 from being removed from the ring 10 while the ring 19 is not being worn. In such event, the range of movement of the door 30 will be limited to the length of the cavity 42 (in the direction of the arrow).

In the preferred embodiment of the ring 10, the setting 14 is substantially rectangular in shape, when viewed from the top. As will be understood by those skilled in the art, the shape of the setting 14 may be varied without departing from the present invention, so long as the shape is one which can be slid through the slot 26. Similarly, while the settings 14, 24, 34, which have been illustrated, are substantially flat (when viewed from the side), other shapes can be used, so long as the shape of the slot 26 (when viewed from the side) is also changed to permit the setting to slide into the opening on the face of the ring 10.

The present invention provides a very simple, yet secure means for providing a ring with interchangeable settings. In view of the ease with which the settings can be changed, and the unlimited number of settings which may be designed, it would be quite cost effective to manufacture the main body of the ring 10 out of a precious metal, such as gold or silver or platinum. A variety of settings can be made available to the wearer. As mentioned above, these settings could encompass a broad range of settings of the type generally known in the art, and could include corporate or fraternal indicia, initials, designs made of precious or semiprecious stones, designs made of metals or lacquer, or a variety of other, similar types of settings.

I claim:

1. A finger ring of the type having a finger opening, said finger ring being adapted to receive and retain interchangeable settings, said finger ring comprising:

(a) a mounting having a front face which extends over a portion of the outer perimeter of the ring, said front face being visible when said ring is being worn, said mounting having a cavity formed therein, said cavity including an opening which extends axially outward through said front face of said mounting;

(b) an entrance slot extending into said opening from a side of said mounting, said side from which said entrance slot extends being generally orthogonal to an axis extending longitudinally through the finger opening of said ring, said slot having a size and shape which is adapted to receive settings which can be slid into said opening; and (c) means for closing said slot when a setting has been inserted into said opening, said means for closing said slot comprising a slidable door which can be slid open when said ring is not on the finger of a wearer, said door sliding away from the face of said mounting into said finger opening, and said sliding door defines an exterior face of said mounting when said ring is worn, whereby when said sliding door is open said interchangeable setting can pass through said entrance slot.

2. The finger ring of claim 1 wherein said slideable door includes a groove for use as a pull for said door.

3. The finger ring of claim 2, further comprising retaining means for securing the door on the mounting when the door is slid open, whereby the door will not completely slide off the mounting when the door is slid open to remove the setting.

4. The finger ring of claim 3 wherein said retaining means for securing the door on the mounting when the door is slid open comprises at least one cavity formed in the recessed portion, a hole in the door which extends through the door, and a pin which extends through the door into the cavity in the recessed portion.

5. The finger ring of claim 4 wherein said pin is permanently fixed in place.

6. The finger ring of claim 5 wherein said pin is soldered in place.

7. The finger ring of claim 4 wherein said pin is removeably fixed in place.

* * * * *